United States Patent [19]

Powell et al.

[11] Patent Number: 5,063,989

[45] Date of Patent: Nov. 12, 1991

[54] METHOD AND APPARATUS FOR PLANAR DRAG STRIP CASTING

[75] Inventors: John C. Powell, Pittsburgh, Pa.; Steven L. Campbell, Middletown, Ohio

[73] Assignee: Armco Inc., Middletown, Ohio

[21] Appl. No.: 543,614

[22] Filed: Jun. 22, 1990

[51] Int. Cl.[5] ..... B22D 11/06

[52] U.S. Cl. ..... 164/463; 164/423

[58] Field of Search ..... 164/463, 423, 429, 479

[56] References Cited

U.S. PATENT DOCUMENTS

| | | | |
|---|---|---|---|
| 4,142,571 | 3/1979 | Narasimhan | 164/88 |
| 4,221,257 | 9/1980 | Narasimhan | 164/87 |
| 4,399,860 | 8/1983 | Johns | 164/463 |
| 4,475,583 | 10/1984 | Ames | 164/423 |
| 4,479,528 | 10/1984 | Maringer | 164/423 |
| 4,484,614 | 10/1984 | Maringer | 164/463 |
| 4,485,839 | 12/1984 | Ward | 164/463 |
| 4,617,981 | 10/1986 | Maringer | 164/453 |
| 4,649,984 | 3/1987 | Bedell et al. | 164/429 |
| 4,768,458 | 9/1988 | Arakawa | 164/463 |
| 4,771,820 | 9/1988 | Williams | 164/463 |

*Primary Examiner*—Kuang Y. Lin

*Attorney, Agent, or Firm*—Larry A. Fillnow; Robert J. Bunyard; Robert H. Johnson

[57] ABSTRACT

The present invention is directed to an improved process and apparatus for strip casting. The combination of a planar flow casting nozzle positioned back from the top dead center position with an attached nozzle extension, provides an increased level of casting control and quality. The nozzle extension provides a means of containing the molten pool above the rotating substrate to increase the control of molten metal at the edges of the strip and increase the range of coating thicknesses which may be produced. The level of molten metal in the containment means is regulated to be above the level of melt supplying the casting nozzle which produces a condition of planar drag flow with the casting substrate prior to solidification.

26 Claims, 3 Drawing Sheets

FIG. 2
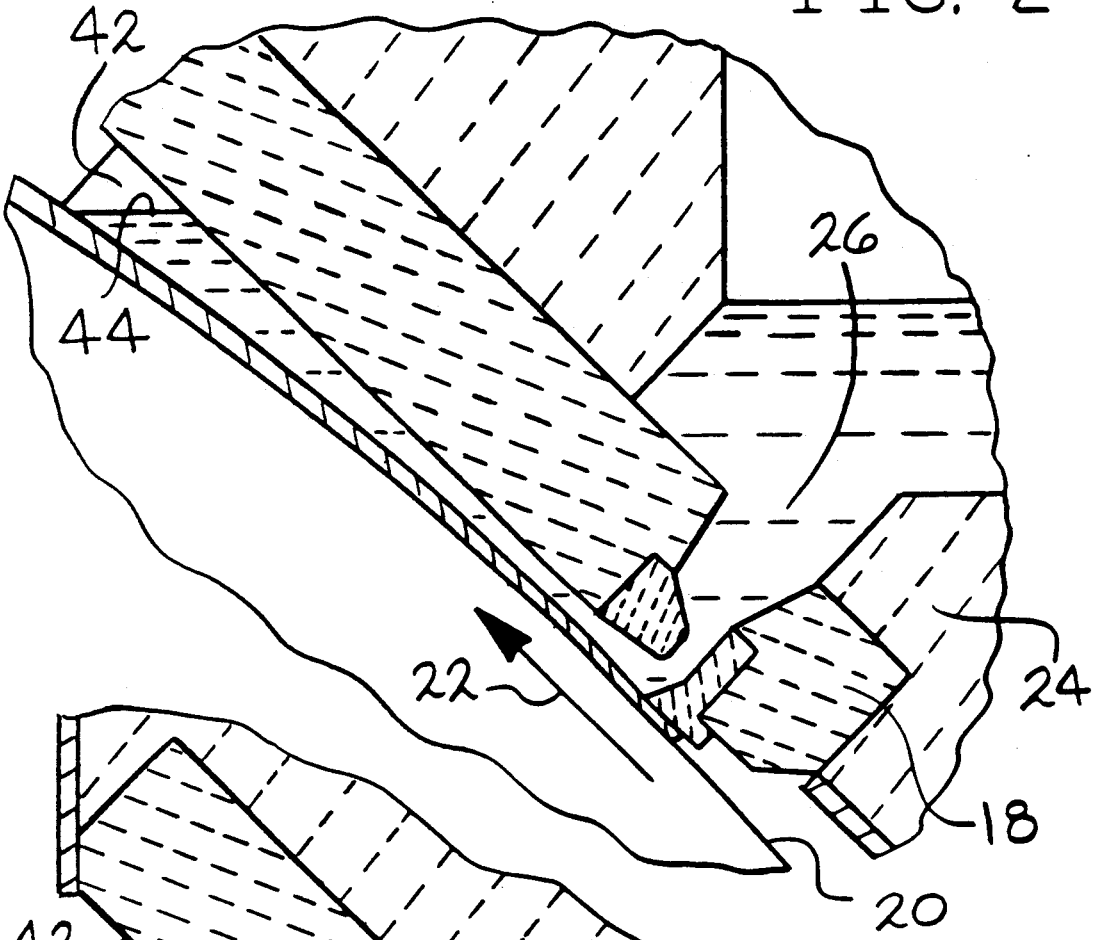
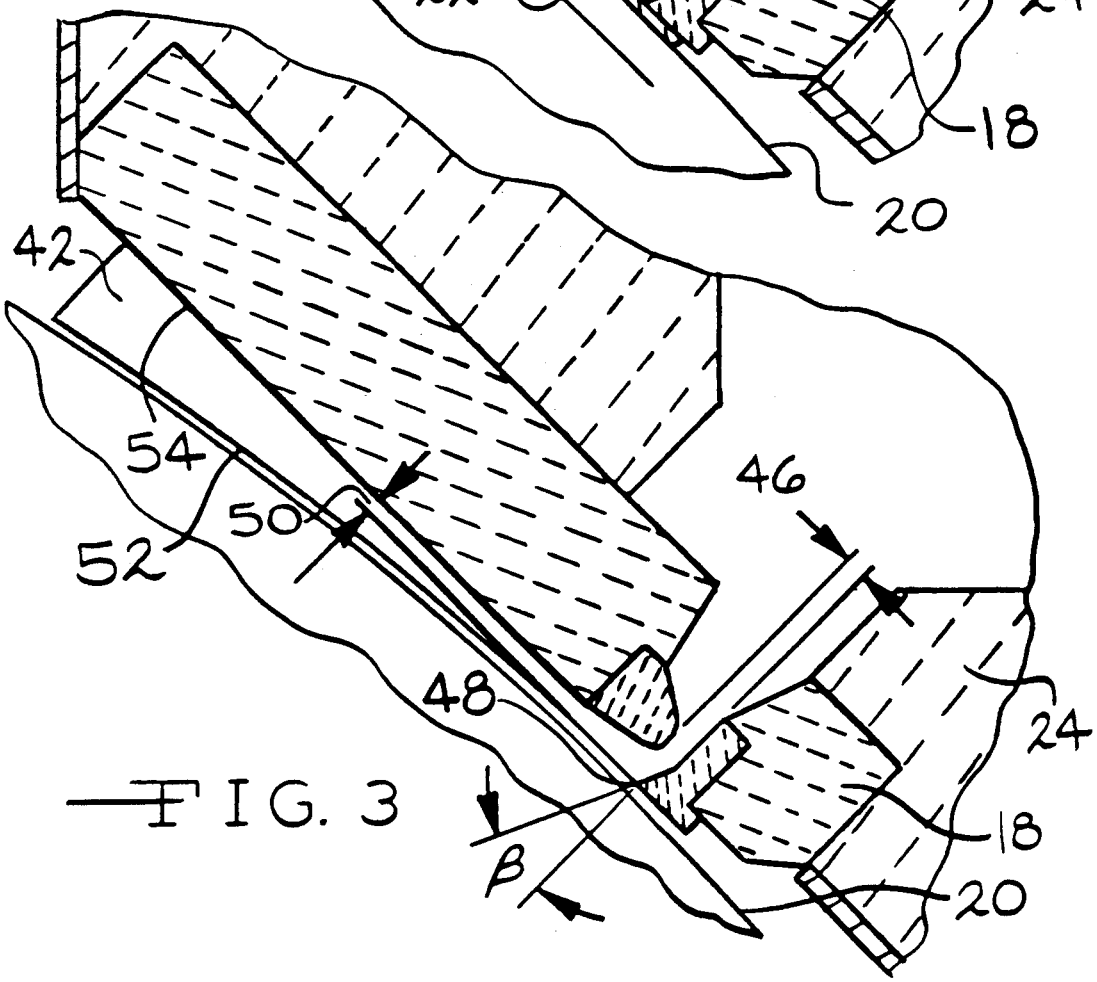
FIG. 3

METHOD AND APPARATUS FOR PLANAR DRAG STRIP CASTING

The Government of the United States of America has rights in this invention pursuant to Contract No. DE-FC07-881ID12712 awarded by the U.S. Department of Energy.

FIELD OF THE INVENTION

The present invention relates to the continuous strand casting of molten material at high production rates. More particularly, the present invention relates to a method and apparatus for continuous casting thin metallic or amorphous strip using a planar drag flow system. Planar drag strip casting uses a single roll or belt with molten metal supplied under head pressure through a nozzle onto the rotating substrate. The molten material forms a stable extended pool on the substrate when the metal flow rate from the nozzle is less than the flow required by the pulling action of the substrate. The nozzle is positioned at a location below the top of the rotating substrate in drag casting and contains the molten pool on the substrate.

BACKGROUND OF THE INVENTION

The general concept of casting thin metallic sheet, strip, foil or ribbon relies on the use of a rapidly rotating substrate, such as a roll or belt that is cooled, and a source of molten metal which is solidified on the substrate in a manner which produces acceptable quality. The substrate must be properly cooled to extract the heat from the molten metal and cause the melt to rapidly solidify.

One of the most difficult problems associated with direct strip casting is the control of gage across the width of the strip. To permit the final product to meet commercial requirements, the variations in thickness across the strip width must be accurately controlled. The quality of the surfaces of the strip must also be controlled to avoid cracks, tears, folds or scale. The cast strip must also control the solidification to be uniform and avoid internal shrinkage voids or cracks.

Melt drag process is normally considered to be directed to casting thicker strip, typically above about 0.01 inches (about 0.25 mm). The molten metal is dragged from a nozzle positioned close to a rotating substrate. U.S. Pat. Nos. 3,522,836 and 3,605,863 use a convex meniscus of molten metal below a nozzle which is contacted by a rotating substrate to draw material from the meniscus. The heat extracting substrate, such as a water cooled drum, moves in a substantially parallel path to the outlet orifice of the nozzle.

In the melt drag process, molten metal forms a meniscus held on by surface tension at the outlet of the casting nozzle. The meniscus is then dragged onto the rotating drum or belt which is continuously cooled. However the melt drag process is severely limited in production speed due to the nature of the meniscus stability and melt flow restrictions. The lower line speeds used are restrictive, particularly to amorphous strip production which require very rapid quenching. U.S. Pat. No. 4,479,528 is typical of nozzles used for casting at a position below the top of the roll.

Planar flow casting systems are generally considered for casting thinner gage materials. Existing strip casting nozzles used for planar flow casting require different features than for planar drag casting. In planar flow, nozzles such as taught in U.S. Pat. No. 4,771,820 and U.S. Pat. No. 4,142,571 have molten metal which falls generally perpendicular to the top of the rotating substrate. The flow of molten material through a slot in the nozzle depends generally on the dimensions of the slot opening, the shape of the nozzle lips, the distances between the lips of the nozzle and the rotating substrate, the head pressure of the melt and the rotation speed of the substrate. In planar flow casting systems, the level of molten metal on the rotating substrate has always been below the molten metal bath level in the pouring box or supply vessel.

In the continuous production of narrow strip, the use of jet casting has been used which directs molten metal under pressure onto the top of a rotating roll. This process has a width limitation due to the difficulty in controlling the jet uniformly even for very short distances. It has been extremely difficult to match a plurality of jets with a uniform spacing and velocity which would provide a uniform pool at the surface of the substrate. Typically, the jet interactions cause ridges between pools and do not apply a uniform thickness across the width of the strip.

The use of two rotating rolls to continuously cast strip has also been attempted with limited success. U.S. Pat. No. 3,862,658 discloses a system for producing amorphous strip using two counter-rotating rolls.

Another strip casting system is called melt overflow which is characterized by the rotating substrate forming the horizontal end wall containment of the molten metal bath. U.S. Pat. Nos. 4,813,472 and 4,819,712 are typical of this approach where the molten pool on the substrate is at about the same elevation as the molten metal in the pouring box.

The progress made in strip casting has resulted in many refinements in the understanding of the basic interrelationships and variables required for uniform strip casting. Numerous modifications and innovations have been developed relating to tundish design, nozzle construction and substrate technology. The various nozzle dimensions evaluated for commercial production have been inadequate to produce the desired uniform strip. The critical dimensional relationships between the casting nozzle and the rotating substrate have yet to be defined which are capable to produce the uniformity and ranges of strip widths and thickness required.

In the past, planar flow casting has balanced the flow of molten material onto the substrate to equal the amount of material required by the pulling action of the substrate. The amount of material which can be in contact with the rotating substrate and solidified in a controlled manner has been limited in the past. The molten material could be pressurized only to a level which did not exceed leakage between the nozzle and substrate. Adjustments in rotation speeds of the substrate were limited to the strip thickness being cast and the cooling capabilities of the substrate. Substrate cooling will control strip thickness in combination with the amount of time the substrate is in contact with the molten pool. However, the cooling may also contribute to freezing of the molten metal in the area of the nozzle discharge. Long contact time will also require a longer contact distance along the arc of the substrate which previously required greater head pressures in the supply of molten metal. These conditions require improved nozzle lip strength to withstand the pressures or a reduction in production speeds if the thickness is to be adjusted and positive seals maintained within the nozzle. Slower wheel speed will also contribute to more freezing in the nozzle. Thicker strip will also have more heat which needs to be removed and complicates the cooling requirements for controlled solidification.

Another problem associated with prior planar flow casting systems was the gap distances between the casting apparatus and substrate being very small and requiring constant attention. This included measuring systems to constantly monitor the gap distances and numerous means to prevent or remove build-up of molten metal on the substrate. Serious restrictions on the static melt pressure tolerated were due to the very small gaps being used.

Accordingly, a new method and apparatus for casting thin metallic or amorphous strip is needed which overcomes the disadvantages of the prior art structures. The desired system must have an improved flexibility which leads to a more uniform cast product and which can produce a broader range of strip widths and gages. A new casting system is also needed which extends the tolerable gap dimensions and static pressures for casting uniform strip.

BRIEF SUMMARY OF THE INVENTION

The present invention provides a new method and apparatus for strip casting which improves the uniformity of strip produced. The nozzle design of the present invention requires a combination of variables be controlled within critical limits to produce the desired strip quality. By extending the length of the nozzle contact with the molten metal around a portion of the casting substrate, a drag casting condition is obtained in combination with the control of planar flow casting at the point of initial contact with the substrate. The nozzle extension increases the molten metal pool length beyond the pool area contained by the nozzle. The increased length of the molten metal pool on the substate is due to the pumping action provided by the substrate and the prolonged pool containment.

The casting system is designed to provide improved side containment of the molten metal on the rotating substrate. The nozzle design improves the quality of the strip width and shape. The nozzle design also provides an improved molten metal pool which increases heat in the top of the pool, insures the solidification commences at the substrate and not at the top of the pool, and provides a broader range of strip thickness due to the increased control of the casting pool on the substrate. By extending the molten pool using the dragging action of the substate, the casting operation is far less dependent on the increase of static pressure being used to adjust the length and depth of the pool on the substrate. The additional containment of molten metal beyond the normal nozzle area has also allowed the gap distances between the casting equipment and the substrate to be increased without increasing static pressures in the pouring box.

Planar drag casting provides a flow of molten metal from a pouring box or reservoir through a slit nozzle. The nozzle directs the molten metal to the rim of a rotating substrate, such as a wheel, drum or belt. A horseshoe shaped trough contains the molten pool and prevents it from spreading. The level of molten metal in the trough is determined by the balance between the flow rate through the nozzle and the rate of strip removal provided by the rotating substrate. Raising the pool level in the trough increases the contact length and time between the molten metal and the substrate. The melt is solidified on the substrate and subsequently removed and coiled. The substrate cooling rates and speeds are adjusted to provide a wide range of strip thickness and widths without freeze-offs in the nozzle.

It is a principle object of the present invention to provide an improved strip casting system which provides a more uniform cast product.

Another object of the present invention to provide a strip casting system which produces strip in a broader range of widths and thicknesses than previously obtainable.

Another object of the present invention is to provide a casting system which provides an increased molten metal pool supply on the substrate without increasing the static head pressure.

An advantage of the present casting system is the ability to control the melt pool by using the nozzle trough extension.

An additional advantage of the present invention is the solidification control attainable with a given set of pouring box and substrate conditions.

A still further advantage of the present invention is the ability to cast strip with increased substrate contact time.

A feature of the present invention is the increased distance over which the melt may achieve solidification prior to being lifted off the substrate.

An additional feature of the present invention is the degree of solidification control and the ability to cast thicker strip with excellent uniformity.

The above and other objects, advantages and features of the invention will become apparent upon consideration of the detailed description and appended drawings.

BRIEF DESCRIPTION OF THE DRAWINGS

FIG. 2 is an enlarged cross-sectional view of FIG. 1 illustrating a nozzle of the present invention;

FIG. 3 is an enlarged cross-sectional view of a nozzle of the present invention without the molten material;

DETAILED DESCRIPTION OF THE PREFERRED EMBODIMENT

Figure 1:
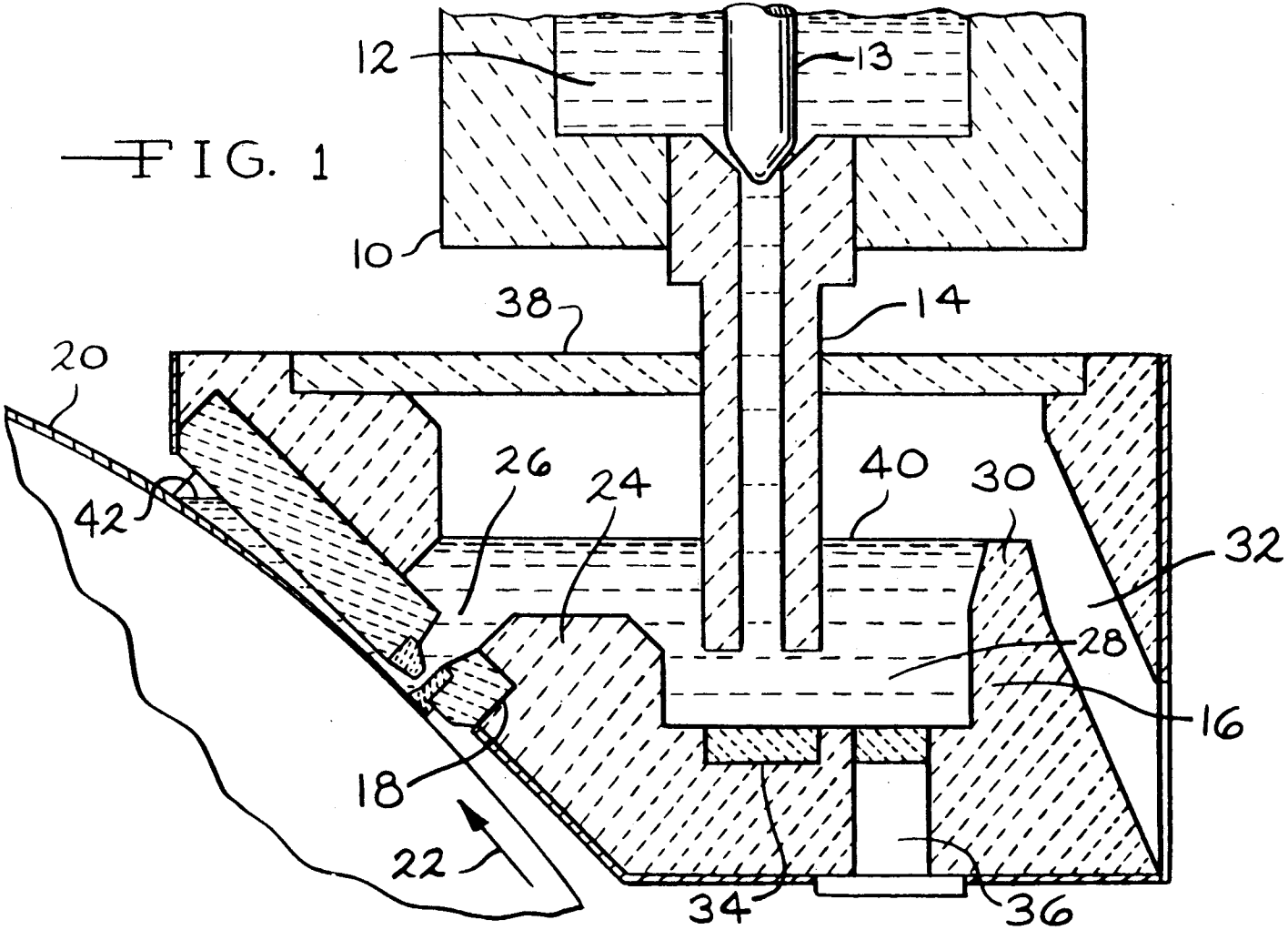
FIG. 1 is a cross-sectional view of a typical strip casting apparatus of the present invention.

The planar drag casting system of the present invention has provided a major improvement to the control of the melt pool which is in contact with the rotating substrate. The pool control provided by this process has increased the ability to produce thicker strip with more uniform properties.

While the present invention will be discussed in terms of a ferrous bath and ferrostatic bath pressure, the present invention is not limited to any molten material and may be crystalline or amorphous. In a preferred embodiment of the invention illustrated in FIG. 1, a refractory lined vessel 10 contains molten metal 12 for continuous strip casting. A stopper rod 13 is used to regulate the flow of molten metal from the vessel 10. Supply nozzle 14 connects vessel 10 with the pouring box 16. Molten metal 12 flows through the casting nozzle 18 under a static head pressure which may be further pressurized by means not shown. A pool forms on a casting substrate 20 rotating in direction 22 at a position which is 20° to 60° back from the top of the substrate 20. The substrate may be a copper wheel or belt and is cooled by means not shown but well known in the art.

A dike 24 assists in providing a uniform flow of molten metal through the casting nozzle 18 and regulates the pouring pool 26 which supplies the casting nozzle. The reservoir 28 in the pouring box has its height regulated by means of an overflow dam 30. The reservoir height 40 may be regulated by other means not shown. The molten metal 12 may erode the bottom walls of pouring box 16 during pouring and a splash pad 34 may be provided to reduce erosion. If the molten metal flow into the pouring box exceeds the desired casting rate, a melt overflow may be provided to allow the metal to flow over the overflow dam 30 and out an overflow chute 32. To avoid the loss of molten metal, a bath level detection system may be provided to maintain the desired bath head pressure. The molten metal may be drained from the pouring box 16 using reservoir drain 36. A pouring box cover or lid 38 may be provided to reduce bath oxidation or enable the bath to be pressurized by means not shown.

The level of the molten metal in the reservoir 28 must be regulated within relatively narrow limits to adjust the static pressure and thus the flow rate through the casting nozzle 18. Means are provided to sense the reservoir level and control the level or maintain the level relatively constant such as by the overflow dam 30 shown. The present invention is characterized by the higher level of molten metal on the rotating substrate when using a planar flow nozzle 18 to cast strip on the substrate 20. When the level 42 of the molten metal on the substrate is above the reservoir level 40, a cast product with improved surface and shape control over a broad range of strip widths and gages.

Referring to FIG. 2, pouring pool 26 above the planar nozzle 18 is regulated in height to provide a static pressure which insures a flow rate that is less than the flow of metal required for the rotating substrate. Namely, the rotational speed of the substrate 20 and the surface conditions of the substrate will require more molten metal than is available.

Prior planar flow casting systems were balanced to provide a uniform pressure throughout the nozzle which provided a flow rate which matched the flow required by the substrate's pulling action. The pulling action depended on substrate speed, substrate surface and the material being cast. The present invention has discovered the casting process is greatly improved if this balance in flow rate is not maintained. If the substrate does not have sufficient molten metal available to provide a flow onto the substrate, the substrate will pull the molten metal pool and drag the metal up further onto the substrate if properly confined. Stretching the pool along the substrate also tends to reduce the turbulence in the pool above the substrate. In prior planar flow casting systems, the balance in flow rates provided a larger pool on surface which had strong turbulent recirculation flow patterns. By reducing the volume of molten metal available in the pool on the substrate, the pumping action of the wheel pulls the molten metal further up the wheel and reduces the amount of metal being recirculated in the pool. With prior casting systems, the increase in pool contact time and length could only have been provided by an increase in static head pressure and this was limited to the pressure the meniscus could tolerate at the nozzle-substrate location without losing the sealing balance and causing leakage. The pool on the substrate in the present invention may be thought of as having a larger flow component along the substrate and less flow of molten metal returning to the pool that is not being dragged onto the substrate. Some molten metal will recirculate to the pool above the substrate in the present invention which serves to stir the pool slightly and provide some stirring action for uniform bath temperature and composition. Some stirring action is also needed to avoid freezing in the nozzle.

Another way to appreciate the difference between drag casting, open channel casting and planar flow casting is to study the change of molten metal pressure in the nozzle. In planar flow casting, the pressure provided by the supply of molten metal is the static pressure, or ferrostatic pressure in the case of ferrous metals. Planar flow casting has a pressure drop through the nozzle which forces molten metal at a flow rate matching the pulling action of the substrate and creates a larger pool on the substrate due to the higher pressures. In channel casting or melt overflow casting, the rotating forms the containment of the nozzle pool and the pressure is the same in the metal supply, nozzle and at the substrate. In planar drag casting, the dragging action of the the substrate with an insufficient molten metal supply causes an increase in pressure at the exit of the nozzle. This is caused by the slight starving of the stream flow at the exit of the nozzle. The substrate wants to pull more metal than there is available. Since there is not enough metal to match the substrate needs, what molten metal is provided will be pulled further onto the substrate when additional nozzle confinement means contain the pool for a greater distance. Since there is a higher pressure at the nozzle exit than the pressure feeding the nozzle, the pool on the substrate is smaller and has reduced recirculation currents.

By dragging the pool 44 further onto the casting substrate, the quality of the cast strip is greatly improved. A retention trough 42 is provided to regulate the edge control to provide excellent gage and shape control. The trough 42 is generally horseshoe-shaped and configured to follow the outer profile of the casting substrate 20. The pouring box 16 is generally located at a position which is about 20° to 60° before the top dead center or top of the rotating substrate. As better seen in FIGS. 3 and 4, the gap between the refractory wall and the substrate is kept small to prevent leakage of molten metal. The wall 48 is sloped at an angle B to the rotation direction at the point of initial contact between between the molten metal and the casting substrate. This angle may vary from 0° to 45° and preferably is from 15° to 35°.

The gap 46 at the point of nozzle discharge will vary from about 0.005 to 0.02 inches depending on the desired gage, molten metal and substrate conditions. Typically the gap will range from about 5 to 15 mils for casting ferrous material with a substrate rotational speed of 5 to 10 feet per second.

Figure 5:
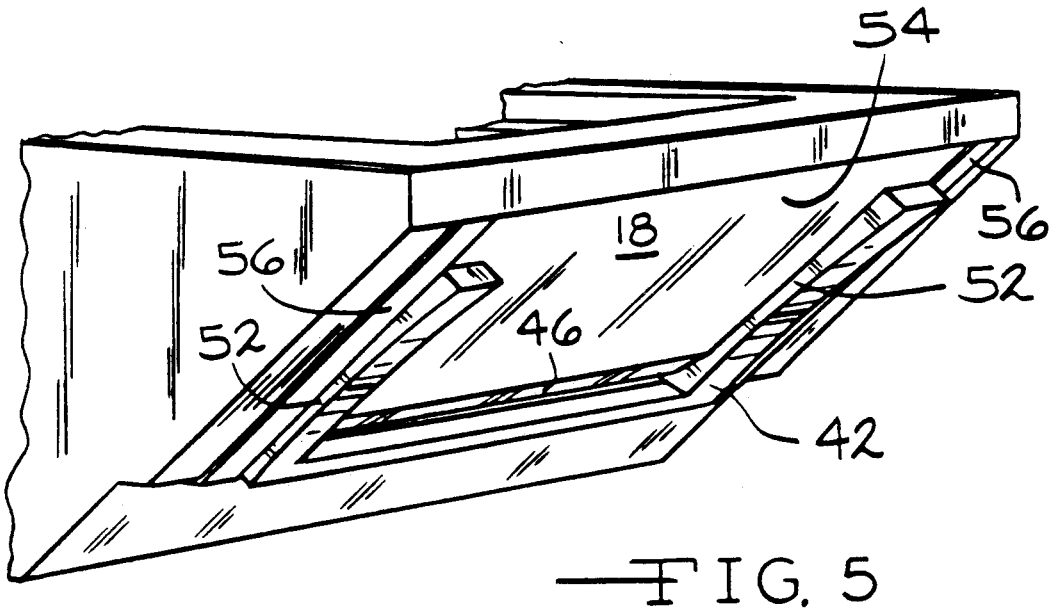
FIG. 5 is a partial perspective view of the exterior of a nozzle-trough delivery system of the present invention.

Referring to FIG. 3 and FIG. 5, the casting trough 42 is shown having a lower trough wall 48, two sidewalls 52 and upper wall 54 which is the outer surface of casting nozzle 18 for containing the molten metal pool. The contour of the the trough will conform to the perimeter or outer surface of the rotating substrate and have a width to provide edge support for the desired width of strip being cast. The contoured sidewalls are angled between 15° to 35° to the substrate. The casting trough may be combined with any planar flow casting nozzle and will provide improved flow and quality as a result of the planar drag casting. Angle irons or other lateral support means 56 may be provided to prevent any outward flexing of sidewalls 52. Various appropriate refractory materials may be used for the trough and nozzle system depending on the metal being cast. Refractories such as boron nitride have been successfully used as a nozzle composition and for trough sidewalls. A high alumina refractory roof has been used in the trough. The length of the trough is determined by the casting parameters to provide a molten pool level above the pouring box height which also provides the desired pool depth for gage requirements.

Figure 4:
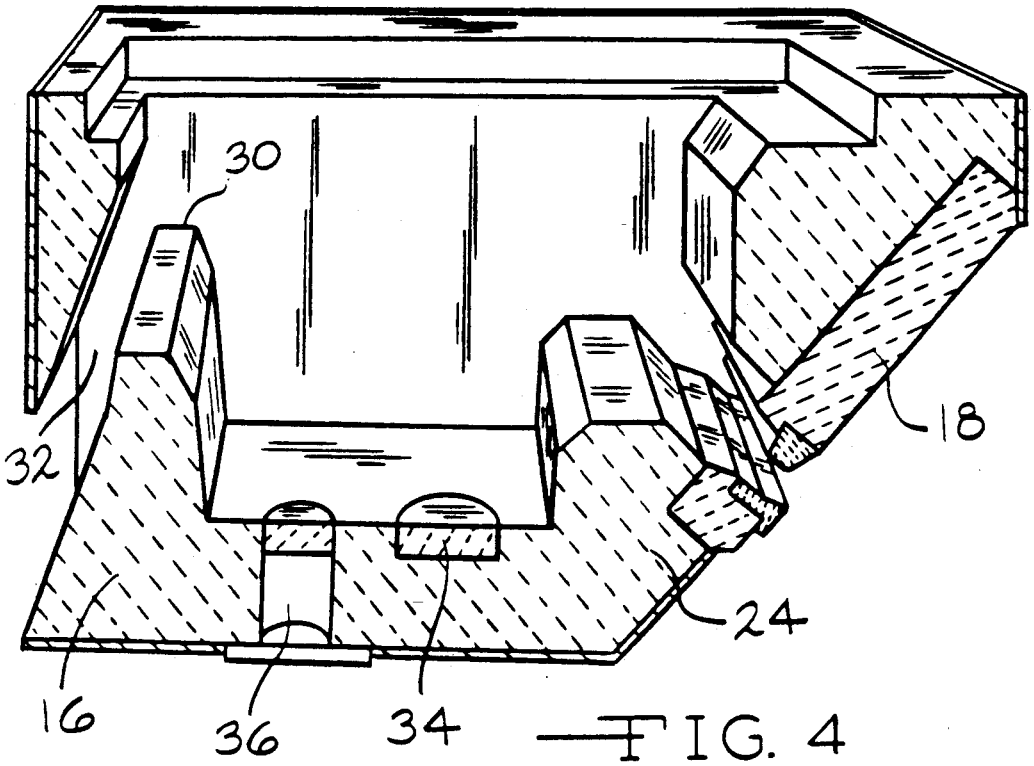
FIG. 4 is a partial perspective cross-sectional view of a casting system of the present invention.

FIG. 4 shows the trough 42 and casting nozzle 18 from an end view looking from the substrate.

The present invention is further illustrated by way of the following example.

EXAMPLE

A melt pouring box was constructed as depicted in FIG. 1 and positioned about 40° back from top dead center of a 7 foot diameter copper substrate wheel. A 3 inch wide casting nozzle was used with a slot opening of about 100 mils. A trough having a 3 inch width was used which had a depth of 375 mils beneath the casting nozzle slot and opened up with the curvature of the wheel. The rear wall of the trough was angled at 26.5° and the trough to substrate gap was set at 10 mils. The trough sidewalls were 7 inches in arc length along the wheel. The overflow chute maintained a 4 inch ferrostatic head over the nozzle during the cast of a low carbon steel molten bath having a temperature of 2965° in the pouring box. The wheel was rotated at a constant speed of 6 feet per second and produced 48 mil thick strip with excellent shape and uniformity. The level of molten metal in the trough was approximately 0.5 inches above the level in the pouring box. The extended pool length on the substrate was supported by the trough edges and provided a uniform gage from edge to edge.

The prior edge control problems with other planar flow casting nozzles was demonstrated to be solved with the present casting method and apparatus. The present invention has shown that excellent shape and gage uniformity is obtainable with the trough extension to planar nozzles. By adjusting the width of the trough and molten level in the trough pool to a molten level at least about 0.5 inches above the melt level in said pouring box, an improved range of strip widths and gages are obtainable.

Whereas the preferred embodiment has been described above for purpose of illustration, it will be apparent to those skilled in the art that numerous modifications may be made without departing from the spirit of the invention. The invention is therefore not limited by these specific embodiments but only to the extent set forth hereafter in the claims which follow.

We claim:

1. A method for producing strip continuously cast from a melt, said method comprising the steps of:

a) containing said melt in a pouring box;

b) maintaining a controlled level of said melt in said pouring box to provide a desired static head pressure;

c) casting said melt from said pouring box through a planar flow nozzle;

d) providing a rotatable casting substrate to receive said melt;

e) containing said melt on said substrate using nozzle extension containment means;

f) maintaining a level of said melt in said nozzle extension containment means to provide a melt level on said substrate which is above said melt level in said pouring box; and g) solidifying said melt to form a continuous cast strip.

2. The method of claim 1 wherein said melt is a ferrous molten metal.

3. The method of claim 1 wherein said casting nozzle is 20 to 60° back from the top of said substrate.

4. The method of claim 1 wherein said pouring box receives said melt from a tundish and said melt level in said pouring box is maintained by a dike and overflow chute.

5. The method of claim 1 wherein said nozzle extension containment means have sidewalls which are shaped to said substrate's outer surface contour.

6. The method of claim 5 wherein said sidewalls are tapered in length.

7. The method of claim 6 wherein said sidewalls are tapered between 15° to 35° to said substrate.

8. The method of claim 1 wherein a nozzle to substrate distance of about 0.005 to 0.020 inches is maintained.

9. The method of claim 1 wherein said melt level in said nozzle extension containment means is at least about 0.5 inches above said melt level in said pouring box.

10. The method of claim 1 wherein said melt is pressurized to regulate the flow of said melt through said casting nozzle.

11. A method of continuous strip casting a melt supplied from a pouring box, through a nozzle and onto a cooled rotating substrate wherein solidification control of said strip is improved, said method comprising the steps of:

a) providing nozzle extension containment sidewalls which increase in height from the nozzle opening to a point of discharge from said containment means and which are configured to the shape of said substrate;

b) providing a nozzle extension containment bottom wall having a slope of 15° to 40° to said substrate; and c) providing a nozzle extension containment top wall whereby said sidewalls, bottom wall and top wall extend said melt on said substrate.

12. The method of claim 11 wherein said melt on said substrate is maintained at a level above said melt level in said pouring box.

13. The method of claim 11 wherein flow control means are provided to control the melt level in said pouring box feeding said nozzle to be below said melt level in said containment means.

14. The method of claim 11 wherein said melt is supplied to said pouring box from a vessel to feed said melt to said nozzle.

15. A method of planar drag strip casting comprising the steps of:

a) providing a bath of molten metal having a depth which provides a static pressure;

b) supplying said metal to a casting nozzle under said static pressure;

c) casting said metal through said nozzle to form a pool on a rotating substrate at a pressure greater than said static pressure;

d) adjusting said substrate pool by providing nozzle extension containment means to extend said pool on said substrate to a level above said bath; and e) solidifying said melt on said rotating substrate to form strip.

16. The method of claim 15 wherein said metal is ferrous.

17. A planar drag strip casting apparatus comprising:

a) a pouring box for supplying molten metal;

b) a casting nozzle connected to said pouring box for casting said molten metal;

c) a cooled rotating substrate which is positioned to receive said molten metal from said nozzle at a position before the top of said substrate; and d) a nozzle extension means to support said molten metal on said substrate to extend said molten metal contact with said substrate wherein said nozzle extension means increase the level of said molten metal to a level above said molten metal level in said pouring box.

18. The apparatus of claim 17 wherein said pouring box is used in combination with a vessel to supply molten metal to said nozzle.

19. The apparatus of claim 17 wherein said metal is ferrous.

20. The apparatus of claim 17 wherein said casting nozzle is positioned about 20° to 60° before the top of said rotating substrate.

21. The apparatus of claim 17 wherein said pouring box is provided with a dike and overflow chute to provide regulation means to control said molten pressure in said pouring box to said nozzle.

22. The apparatus of claim 17 wherein said nozzle extension means have sidewalls shaped to said substrate's outer surface.

23. The apparatus of claim 17 wherein said pouring box includes a pouring box cover and pressurizing means to regulate said molten metal flow through said nozzle.

24. The apparatus of claim 17 wherein said nozzle is spaced from about 0.005 to 0.020 inches from said substrate at the point of melt discharge.

25. A planar drag strip casting apparatus comprising:

a) a vessel for supplying molten metal;

b) a pouring box for receiving said molten metal from said vessel and for maintaining a static pressure level for casting;

c) a casting nozzle connected to said pouring box for casting said molten metal;

d) a cooled rotating substrate positioned to receive said molten metal from said nozzle; and e) a nozzle extension means to support and extend said molten metal on said substrate to a level above said molten metal in said pouring box.

26. A method of continuously casting strip on a cooled rotating substrate, said method comprising the steps of:

a) containing a melt within a pouring box;

b) supplying a casting nozzle with said melt from a pouring box at a static pressure;

c) positioning said casting nozzle about 20° to 60° before the top of a rotating substrate at a distance of about 5 to 20 mils from said substrate;

d) extending the melt contact length on said substrate by nozzle extension containment means to a substrate melt level above said melt in said pouring box; and e) maintaining said substrate melt level by increasing the melt pressure at the exit of said nozzle to a pressure level above said pouring box static pressure, said melt pressure increase being provided by insufficient melt supply for said substrate rotation.

* * * * *